United States Patent [19]

Hempel, Jr. et al.

[11] 4,180,959

[45] Jan. 1, 1980

[54] MACHINE FOR SEALING FOOD CONTAINERS

[76] Inventors: Robert P. Hempel, Jr., Rua Manuel Pereira Guimares, 614, Sao Paulo, Brazil, 04722; Elder Rondelli, Av. Sabia, 699 Apt. 11, Sao Paulo, Brazil, 04515

[21] Appl. No.: 933,283

[22] Filed: Aug. 14, 1978

[30] Foreign Application Priority Data

Oct. 31, 1977 [BR] Brazil ..... 7707256

[51] Int. Cl.[2] ..... B65B 7/28

[52] U.S. Cl. ..... 53/334; 53/366

[58] Field of Search ..... 53/333, 334, 338, 366, 53/363, 329,

[56] References Cited

U.S. PATENT DOCUMENTS

| | | | |
|---|---|---|---|
| 2,933,873 | 4/1960 | Swanson | 53/334 |
| 3,369,342 | 2/1968 | Tessitore | 53/366 |

*Primary Examiner*—Travis S. MCGehee

*Attorney, Agent, or Firm*—Christie, Parker, & Hale

[57] ABSTRACT

A machine for sealing food containers is disclosed which includes a horizontal base and support means attached to the base for supporting a container to be sealed. A ring is attached to the support means which ring has a first indentation forming a concentric circle with the ring and on the surface of the ring. A second indentation lies within the first indentation. A first horizontally extending arm is pivotally linked to the base for allowing vertical movement of the arm. A vertically extending arm is attached to such first horizontal arm and extends downward and is centered within the ring. A disk is attached at its center to the vertical arm. Such disk has a diameter greater than the inside diameter of the ring but less than the outside diameter of the ring. A vertical sleeve encircles the vertically extending arm and is rotatable about such vertical extending arm. A second horizontal arm is attached to the vertical sleeve and is also rotatable about the vertical arm. A train of rollers is attached to the second horizontal arm which train includes a first smooth vertical roller adapted for moving along such first indentation on the surface of the ring, a second horizontal roller following the first roller and having a radius extending inward of the ring over the first indentation, and a second vertical roller following the horizontal roller having a projection for engaging the second indentation and adapted for moving along such second indentation on the ring.

5 Claims, 6 Drawing Figures

MACHINE FOR SEALING FOOD CONTAINERS

BACKGROUND OF THE INVENTION

The present invention relates to a machine for sealing containers that are used particularly for food products, specially those processed food products that are sold in snack shops, delicatessens, luncheonettes, and restaurants. These containers for processed food are also used in hospitals, industry, and wherever large numbers of persons must be fed at about the same time.

It is generally known and well established, and with increasing acceptance, that many times the consumer prefers to take food purchased in such a processed food establishment to his home for consumption in his home. There he can be informal and in complete comfort and more inportantly such processed food taken home is less expensive than if eaten in the restaurant.

Naturally there have been many proposals for machines to seal containers and there have been many proposals for the proper container, form, raw material for such containers, and, of course, the machine or system to hermetically seal the container to provide the most perfect conservation of the food.

With reference particularly to the machine to seal food containers, there are several known types and models. A major part of such machines is the characteristic of sealing with heat which creates many problems and restricts the use of the machine. Usually the machine sealing with heat must be located near an electric outlet in the restaurant which limits the opportunities to use the machine in other locations in the restaurant such as during the rush hour.

There are, of course, machines to seal containers that are called "cold sealing." Such machines eliminate the restrictions that characterize the machines that seal with heat. However, such cold sealing machines have other problems that hinder production and prevent efficient sealing. For example, on a machine which uses pressure to seal a container, the lips of the containers must be erect and the lid of the machine must make a perfect contact on all points of the lips of the container to seal the container. A one degree variance from the 90 degree angle can prevent sealing. Further, the noise created when the machine is in operation is detrimental to employees' and customer's comfort and hearing.

There is also a machine for cold sealing which uses a system of sealing by small perforations. A major problem with such a machine is that the equipment is fixed in a location and the container must revolve to receive the perforations thereby sealing the lid with the bottom of the container. Ruptures in the sides of the container are frequent in the handling of the container causes mixtures of the food products.

In view of the state of the art sealing machines and problems presented by their use, a new type of sealing machine is desired.

SUMMARY OF THE INVENTION

The present invention relates to a machine for sealing food containers which includes a horizontal base and support means attached to the base for supporting a container to be sealed. A ring is attached to the support means which ring has a first indentation forming a concentric circle with the ring and on the surface of the ring. A second indentation lies within the first indentation. A first horizontally extending arm is pivotally linked to the base for allowing vertical movement of the arm. A vertically extending arm is attached to such first horizontal arm and extends downward and is centered within the ring. A disk is attached at its center to the vertical arm. Such disk has a diameter greater than the inside diameter of the ring but less than the outside diameter of the ring. A vertical sleeve encircles the vertically extending arm and is rotatable about such vertical extending arm. A second horizontal arm is attached to the vertical sleeve and is also rotatable about the vertical arm. A train of rollers is attached to the second horizontal arm which train includes a first smooth vertical roller adapted for moving along such first indentation on the surface of the ring, a second horizontal roller following the first roller and having a radius extending inward of the ring over the first indentation, and a second vertical roller following the horizontal roller having a projection for engaging the second indentation and adapted for moving along such second indentation on the ring.

Among the many characteristics of the machine of this invention is that the machine utilizes a cold seal method of sealing the food containers, thereby eliminating restrictions of hot seal food container sealing methods such as the inherent dependency on electric energy and electric outlets. The machine can be used in any convenient location for cold sealing food containers.

The sealing of the container is accomplished by simply folding a lip provided on a cover for the container and a lip provided on the container. There is no requirement for glue, heat, air pressure and/or perforations. With such interfolding of the lip of the cover and the lip of the container a hermetic seal is provided which provides substantial protection for the contents of the container.

During the sealing process, the container is held stationary in a support. A train of rollers descends and rides in a circular manner concomitantly over the lip of the cover and the lip of the base. The sealing is accomplished by a special fold of the lips without any appreciable risk that the container will rupture or that there will be a mixture of the contents of the container.

DRAWINGS

These and other features and advantages of the present invention will be appreciated as the same becomes better understood by reference to the following detailed description and accompanying drawings wherein.

DETAILED DESCRIPTION OF THE INVENTION

Figure 1:
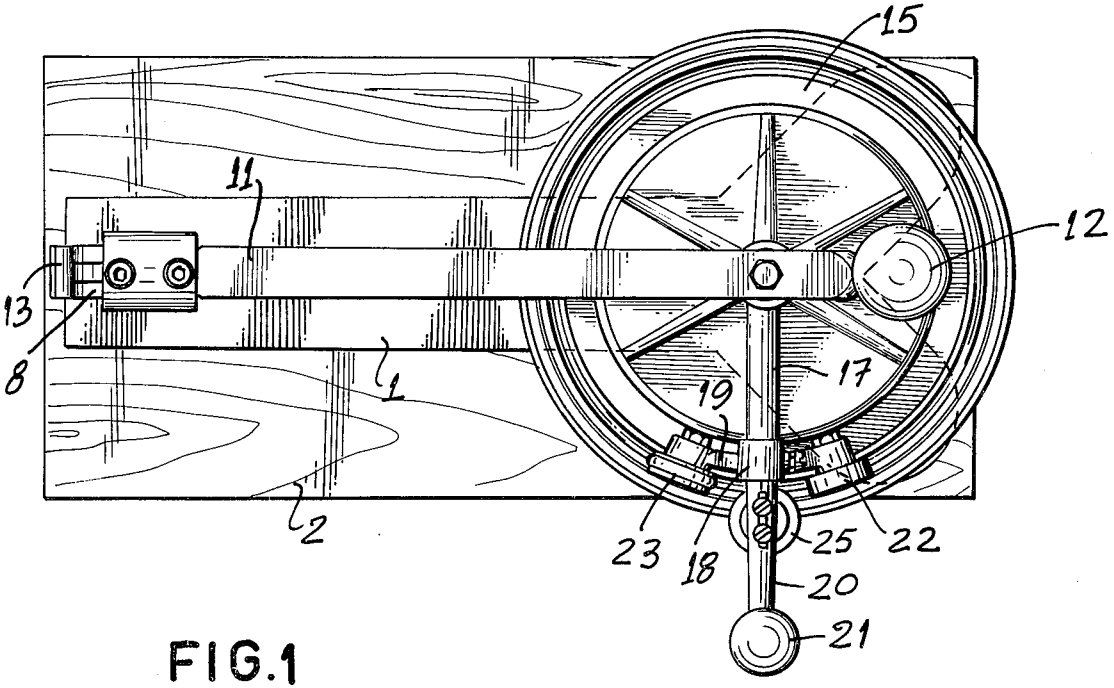
FIG. 1 is a top elevation view of an embodiment of the sealing machine of this invention.

With reference to the drawings, the machine for sealing food containers has a horizontal base 1. Such a horizontal base can have any convenient configuration but in the preferred embodiment shown in FIG. 1 the horizontal base is a flat and rigid plate in the form of a Y. In the operation of the machine the Y-shaped can be fixed on a work table or may be fixed on a wooden base 2 for making the machine portable. A support means 4 is mounted on top of the Y-shaped base for supporting the container to be sealed. Such support means 4 has attached thereto a horizontal ring 3. The horizontal ring can be made of metal or any other convenient material. Although the drawings show a circular horizontal ring, the ring can be any configuration depending on the container to be sealed such that the ring can be square or rectangular. The dimensions and diameter of the ring shown in the drawings can be any convenient dimensions also dependent on the size of the container to be sealed. The support means can be any convenient type of means for supporting such a ring 3. For example, such support means can be vertical columns as shown at 4 in FIG. 2.

Figure 3:
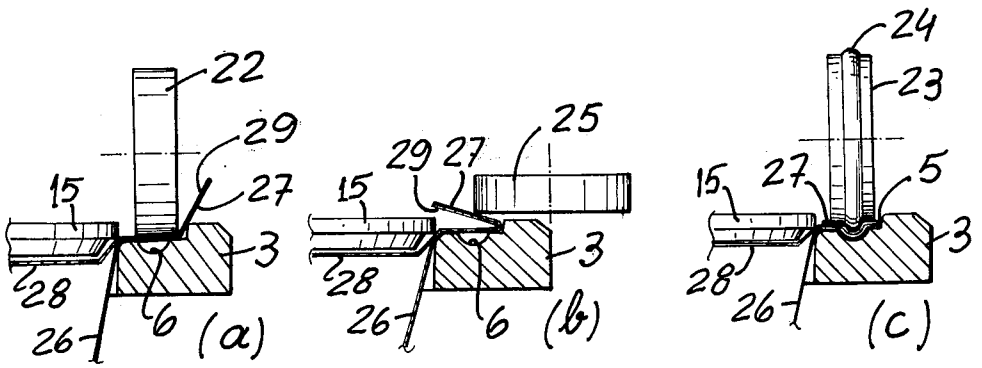
FIGS. 3*a*, 3*b* and 3*c* are an amplified view partially in section illustrating the sequence of special folding of the lip of the lid and the lip of the container being sealed by the machine of this invention.

With reference to FIG. 3 the horizontal ring has a first indentation 5 cut into the surface of the ring. Such a first indentation 5 forms a concentric circle with the circumference of the ring. Within the first indentation 5 is cut a second indentation 6 encircling the ring thus also forming a concentric circle with the circumference of the ring 3. Such a second indentation 6 can be a concave channel cut into the first indentation 5.

At the end of base 1 opposite the support means 4 is mounted a vertically extending arm 7 which has a forked end 8 and an end attached to the base 1 which is opposite such forked end 8. The forked end 8 functions as a pivot point for a second vertically extending arm 10. Such a second vertically extending arm 10 is pivotally attached to the forked end 8 of arm 7 by pivot pin 9. The second vertical arm 10 is free to pivot about the pivot pin 9. Attached to the end of the second vertical extending arm 10 opposite the point of pivoting about pivot pin 9 is a first horizontally extending arm 11. Such a horizontal arm 11 is free to move concomitantly with arm 10, the movement of arm 11 being substantially vertical. The first horizontal extending arm 11 extends above the ring 3 and support means 4 for a container to be sealed. Such an arm 11 can have a sphere attached to the end of the arm 11 opposite the vertical arm 10.

Figure 2:
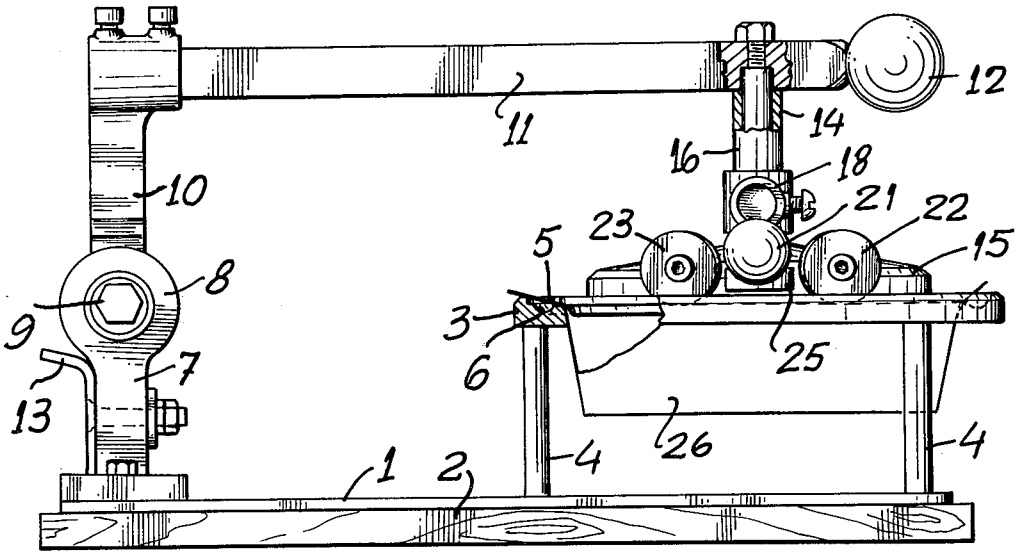
FIG. 2 is a lateral view, partially in cross section of the embodiment shown in FIG. 1 and also illustrates a container inside the sealing machine.

As shown in FIG. 2, a stop 13 can be attached to the first vertical arm 7 for controlling the rotation of arm 10 about pivot pin 9. In this manner, the vertical movement of the first horizontal arm 11 can also be controlled by the stop 13 as the horizontal arm 11 moves concomitantly with arm 10.

The first horizontal extending arm 11 has a vertical and downwardly extending arm 14. The downwardly extending arm 14 is centered over the center of ring 3. On the end of the arm 14 is attached a horizontal disk 15. The horizontal disk has a diameter greater than the inside diameter of the ring but less than the outside diameter of the ring. Preferably, as shown in FIG. 3, the diameter of the disk 15 is less than the diameter of the circle formed by the second indentation 6. The disk 15 is an inverted frustum with an upper surface having a diameter greater than the diameter of the inside of the ring and a lower surface having a diameter less than the diameter of the inside of the ring. As the disk has a greater diameter than the inside of the ring, the disk can be held firmly against the ring for securely holding a container and lid during the sealing operation.

Around the vertical arm 14 is a cylindrical sleeve 16 which is free to rotate about the arm 14. To this cylindrical sleeve is attached a second horizontal arm 17 which extends from the sleeve outwardly to about the periphery of the disk 15.

The second horizontal arm 17 is free to rotate about the vertical arm 14 as the arm is mounted on the cylindrical sleeve 16.

A bushing 18 is mounted on the second horizontal arm 17. The bushing 18 has a pair of lower lateral arms 19 and an extension 20. This extension 20 has at its extremity a sphere 21 which is used to guide the sealing mechanism of the sealing machine in its projectory around the container and ring 3.

The sealing mechanism of the machine comprises a train of rollers. Each of the lateral arms 19 have axially affixed thereto a vertical roller 22 and 23. The vertical rollers 22 and 23 are held in position by the arms 19 directly over the ring 3 and directly above the first indentation 5 on the ring 3. The roller 22 has a smooth surface on which it rolls and the roller 23 has a projection 24 for engaging the second indentation 6 on the ring 3. The extension 20 also has a roller 25 which is positioned horizontally between the vertical rollers 22 and 23. The position of the horizontal roller 25 can be adjusted vertically to vary the distance between the roller 25 and the ring 3.

In operation, the sealing of food containers is accomplished in the following manner. The first horizontal arm 11 is lifted by grasping the sphere 12 and pushing upward, thereby rotating vertical arm 10 about pivot pin 9 until it is stopped by the stop 13. As the disk 15 and the sealing mechanism including the train of rollers 22, 23, and 25 are attached to the horizontal arm 11, they are also lifted in a vertical position concomitantly with arm 11.

Following the lifting of arm 11 a container 26, such as is normally made of aluminum foil having a frusto-conical form and possessing a cover 27 is placed within the ring 3 supported by the support means 4. The cover 27 to be sealed on the container, usually made of the same material, is placed on the container. The container has a lip that has a diameter of the top of the container greater than the inside diameter of the ring 3. The cover also has a lip that has a diameter about equal to the diameter of the top of the container.

The horizontal arm 11 is then lowered and the disk 15 engages the lid 27 and container 26 securing the lid and container to ring 3. The sphere 21 which is connected to the vertical arm 20 is then rotated manually around the vertical arm 14. As the arm 20, which is an extension of arm 17 is rotated about vertical arm 14, the vertical wheels 22 and 23 roll in a circular fashion about ring 3. The first roller 22 having a smooth surface folds the lip 27 of the container and the lip 29 of the cover to a near vertical position as shown in FIG. 3*a*. Immediately following the first vertical roller 22, the horizontal roller 25 folds the lips 27 and 29 to a near horizontal position (FIG. 3*b*). Following the horizontal roller 25, the vertical roller 23 having the projection 24 rolls along ring 3 closing the lips 27 and 29 in the second indentation of ring 3 (FIG. 3*c*). Thus, the cover and container are hermetically sealed.

The first horizontal arm 11 is then lifted and the container is removed. The machine is then ready to repeat the operation with other containers to be hermetically sealed.

What is claimed is:

1. A machine for sealing food containers comprising:

(a) a horizontal base;

(b) support means attached to the base for supporting a container to be sealed;

(c) a ring having an inside diameter and an outside diameter attached to the support means, the ring having a first indentation forming a concentric circle on the surface of the ring and a second indentation within the first indentation;

(d) a first horizontally extending arm pivotally linked to the base for allowing vertical movement of the arm;

(e) a vertically extending arm attached to the first horizontal arm, extending downward and centered within the ring;

(f) a disk attached at its center to the vertical arm, such disk having a diameter greater than the inside diameter of the ring but less than the outside diameter of the ring;

(g) a vertical cylindrical sleeve encircling and rotatable about the vertical arm;

(h) a second horizontal arm attached to the vertical sleeve and rotatable about the vertical arm; and (i) a train of rollers attached to the second horizontal arm comprising a first smooth vertical roller adapted for moving along the first indentation on the ring, a horizontal roller following the first roller having a radius extending inward of the ring over the first indentation, and a second vertical roller following the horizontal roller having a projection for engaging the second indentation and adapted for moving along the second indentation on the ring.

2. A machine for sealing food containers as recited in claim 1 wherein the first horizontally extending arm is attached to the base by a pivotal linking means comprising:

(a) a first vertical arm having a forked end with the end opposite the forked end attached to the base; and (b) a second vertical arm having one end pivotally attached to the forked end of the first vertical arm and a second end attached to the first horizontal arm.

3. A machine for sealing food containers as recited in claim 1 wherein the disk is an inverted frustum with an upper surface having a diameter greater than the inside diameter of the ring and a lower surface having a diameter less than the inside diameter of the ring.

4. A machine for sealing food containers as recited in claim 1 wherein the horizontal roller in the train of rollers is adjustably positioned above the surface of the ring.

5. A machine for sealing food containers as recited in claim 1 further comprising a stop for controlling the vertical movement of the first horizontal arm.

* * * * *

UNITED STATES PATENT AND TRADEMARK OFFICE

CERTIFICATE OF CORRECTION

PATENT NO. : 4,180,959

DATED : January 1, 1980

INVENTOR(S) : Robert P. Hempel, Jr. and Elder Rondelli

It is certified that error appears in the above-identified patent and that said Letters Patent are hereby corrected as shown below:

Item [21] Appl. No.: change "933,283" to -- 933,263 --.

Line 7, column 1, change "specially" to -- especially --.

Line 53, column 1, after the word "container" insert the word -- which --.

Line 66, column 2, after the word "Y-shaped" insert the word -- base --.

Signed and Sealed this

*Third* Day of *June 1980*

[SEAL]

*Attest:*

SIDNEY A. DIAMOND

*Attesting Officer*

*Commissioner of Patents and Trademarks*